US005950442A

United States Patent [19]

Maeda et al.

[11] Patent Number: 5,950,442

[45] Date of Patent: Sep. 14, 1999

[54] AIR CONDITIONING SYSTEM

[75] Inventors: Kensaku Maeda; Tai Furuya; Hiroyasu Nowatari, all of Fujisawa, Japan

[73] Assignee: Ebara Corporation, Tokyo, Japan

[21] Appl. No.: 08/863,062

[22] Filed: May 23, 1997

[30] Foreign Application Priority Data

| | | | |
|---|---|---|---|
| May 24, 1996 | [JP] | Japan | 8-153409 |
| May 24, 1996 | [JP] | Japan | 8-153411 |
| Jun. 7, 1996 | [JP] | Japan | 8-168208 |

[51] Int. Cl.[6] ..... F25B 7/00; F25B 25/00

[52] U.S. Cl. ..... 62/175; 62/176.6; 62/332

[58] Field of Search ..... 62/91, 94, 175, 62/332, 271, 176.6; 236/44 C

[56] References Cited

U.S. PATENT DOCUMENTS

| | | | |
|---|---|---|---|
| 3,102,399 | 9/1963 | Meckler | 62/94 X |
| 4,430,864 | 2/1984 | Mathiprakasm | 62/94 |
| 4,887,438 | 12/1989 | Meckler | 62/271 |
| 4,955,205 | 9/1990 | Wilkinson | 62/94 |
| 4,984,434 | 1/1991 | Peterson et al. | 62/94 |
| 5,020,334 | 6/1991 | Wilkinson | 62/94 X |
| 5,325,676 | 7/1994 | Meckler | 62/94 X |
| 5,448,895 | 9/1995 | Coellner et al. | 62/94 |
| 5,758,509 | 6/1998 | Maeda | 62/94 |
| 5,816,065 | 10/1998 | Maeda | 62/94 X |
| 5,826,641 | 10/1998 | Bierwirth et al. | 62/94 X |

OTHER PUBLICATIONS

U. S. application No. 08/781,038, K. Maeda, filed Jan. 9, 1997, Air Conditioning System.

U.S. application 08/780,276, K. Maeda, filed Jan. 9, 1997, Desiccant Assised Air Conditioning System.

*Primary Examiner*—William Wayner

*Attorney, Agent, or Firm*—Armstrong, Westerman, Hattori, McLeland & Naughton

[57] ABSTRACT

The air conditioning system can lower the cost by saving the energy through the use of a combination of a circulation type unit and outdoor air intake type unit, as well as simplification of mechanical arrangements. The air conditioning system comprises a first air conditioning unit for processing outdoor air and introducing processed outdoor air into indoors while discharging indoor air to outside; and a second air conditioning unit for processing indoor air while circulating the indoor air. The first air conditioning unit comprises: a desiccant device for adsorbing moisture from the outdoor air and being regenerated by the indoor air to be discharged; and a heat pump device functioning as a heat source for regenerating the desiccant device. A high temperature heat source of the heat pump device is used for heating regeneration air and a low temperature heat source of the heat pump device is used for cooling the outdoor air.

16 Claims, 18 Drawing Sheets

AIR CONDITIONING SYSTEM

BACKGROUND OF THE INVENTION

1. Field of the Invention

The present invention relates in general to air conditioning systems, and relates in particular to so-called hybrid air conditioning systems that combine desiccant air conditioning and a heat pump device.

2. Description of the Related Art

FIG. 18 is a schematic representation of a conventional air conditioning system combining a ventilation unit 1A for introducing outdoor air for process air (for conditioning space) while discharging indoor air to the outside and an air conditioning unit 3 for circulating process air. The ventilation unit 1A is a total enthalpy heat exchanger and performs heat exchange simultaneously of both latent heat for humidity as well as sensible heat between the indoor air and the outdoor air. In the meantime, air conditioning load within the conditioning space is withdrawn by the air conditioning unit (using a heat pump) 3 and is discarded to the outside environment.

The efficiency of such an enthalpy heat exchanger is low and ranges between 50~55%, resulting in that between 45~50% of the moisture contained in outdoor air is brought into the conditioning space. This moisture must be removed by the air conditioning unit 3, and therefore, it is necessary for the air conditioning unit 3 to lower the operating temperature of a heat exchanger 4 (low temperature heat source) to a temperature below the dewpoint (15~16° C.) of the indoor air, for example to 10° C. The result is that the temperature difference (temperature lift) between the evaporating temperature and the condensing temperature for the air conditioning unit 3 has to be set to a same value as when the enthalpy heat exchanger 1A is not being used, leading to high energy consumption.

Also, the air conditioning unit 3 must have a drain provision to drain the moisture condensation, thus necessitating an additional mechanical arrangement.

Furthermore, because the air conditioning unit 3 had to simultaneously process both the latent heat (moisture removal) and the sensible heat (cooling of process air), the humidity of the conditioning space was affected by the temperature conditioning process, and could not be controlled sufficiently.

There are a few air conditioners having a humidity reduction mode of operation, however, dehumidification efficiency is not sufficient in these units because the basic approach of removing the moisture by cooling leads to a low temperature of the conditioned space.

SUMMARY OF THE INVENTION

It is a primary object of the invention to lower the cost of an air conditioning system by saving the energy through the use of a combination of a circulation type unit and an outdoor air intake type unit, as well as simplification of mechanical arrangements.

Another object of the invention is to provide an air conditioning unit to offer a high performance in humidity reduction while providing energy saving through a combination of a circulation type air conditioning unit and an outdoor air intake type air conditioning unit.

The above objects have been accomplished by an air conditioning system comprising a first air conditioning unit for processing outdoor air and introducing processed outdoor air into the indoors while discharging indoor air to the outside; and a second air conditioning unit for processing indoor air while circulating the indoor air, wherein the first air conditioning unit comprises: a desiccant device for adsorbing moisture from the outdoor air and being regenerated by the indoor air; and a heat pump device functioning as a heat source for regenerating the desiccant device; wherein a high temperature heat source of the heat pump device is used for heating regeneration air and a low temperature heat source of the heat pump device is used for cooling the introduced outdoor air.

In such an arrangement, by using the desiccant assisted first air conditioning unit, it is possible to have a lower humidity ratio in the supply air for the conditioning space than that in the indoor air, and the moisture is prevented from being introduced into the conditioning space. Therefore, the second air conditioning unit does not need to dehumidify the process air, and it only needs to process the sensible heat in the indoor air. This leads to a lower temperature lift value for the second air conditioning unit. Further, because the necessity for dehumidification by the second air conditioning unit has been eliminated, the necessity for a drain facility has also been eliminated.

DESCRIPTION OF THE PREFERRED EMBODIMENTS

Figure 1:
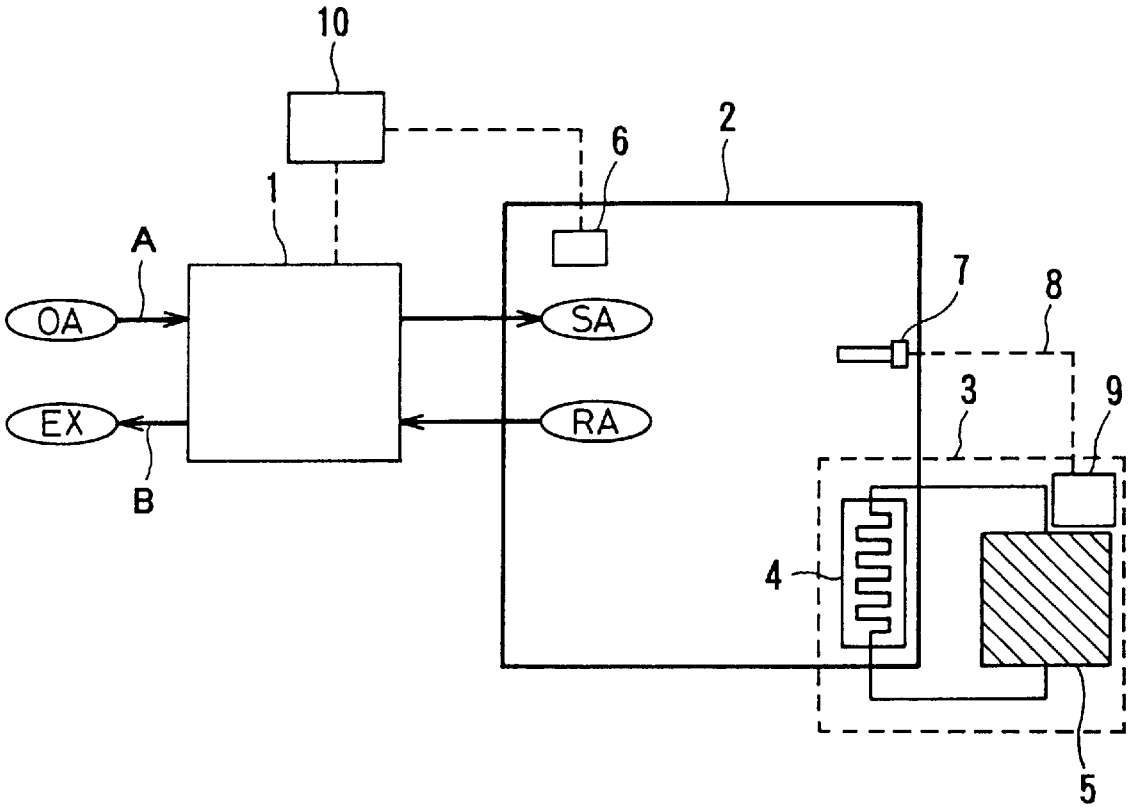
FIG. 1 is a schematic representation of a first embodiment of the air conditioning system of the present invention.

A first embodiment will be explained with reference to FIGS. 1–4. FIG. 1 is a schematic representation of a first embodiment of the air conditioning system, based on a hybrid system combining a first air conditioning unit 1, which is an outdoor air intake type air conditioning unit for processing outdoor air and introducing it into the conditioning space 2 while discharging indoor air to outside; and a second air conditioning unit 3, which is a circulation type air conditioning unit for circulating and processing indoor air in the conditioning space 2. The second air conditioning unit 3 may be a regular air conditioner using a refrigeration unit and a heat pump device 5, but other types of air conditioning devices may be substituted.

Inside the conditioning space 2, there is a humidity sensor 6 provided for determining the humidity level within the space 2, and the output signal from the sensor 6 is input into a controller 10. The controller 10 controls the operation of the first air conditioning unit 1, as will be explained later, in accordance with the values of humidity sensor 6. Inside the conditioning space 2, there is also provided a temperature sensor 7, and the output signal from the sensor 7 is input into another controller 9 by way of a signal path 8. The controller 9 controls the operation of the second air conditioning unit 3 in accordance with the values of temperature sensor 7.

The first air conditioning unit 1 is a desiccant assisted outdoor air intake type device based on a heat pump device 200 and a desiccant wheel 103, which repeats the processes of moisture adsorption and desiccant regeneration. The first air conditioning unit 1 comprises an outdoor air inlet passage (process air passage) A for introducing outdoor air into the conditioning space 2 and an outlet passage (regeneration air passage) B for discharging the indoor air to outside environment. Between the inlet passage A and the outlet passage B, there are the desiccant wheel 103, a heat exchanger 104, and a heat pump device 200 which is a heat source for the air conditioning unit 1. Any type of heat pump device may be utilized, but in this embodiment, a vapor compression type heat pump which had been proposed by the inventor in an earlier U.S. patent application Ser. No. 08/781,050 is used.

The process air passage (outdoor air inlet passage) A is constructed as follows: the outdoor space is communicated with the intake of the blower 102 through the passage 107; the outlet of the blower 102 is communicated with the desiccant wheel 103 through the passage 108; the discharge for the process air from the desiccant wheel 103 is communicated through the passage 109 with the sensible heat exchanger 104 heat-exchangeable with the regeneration air; the outlet for the process air from the heat exchanger 104 is communicated with the chilled water heat exchanger (cooler) 210 through the passage 110; the outlet for the process air from the cooler 210 is communicated with the conditioning space through the passage 111; thereby completing a processing cycle for the process air.

In the meanwhile, the regeneration air passage (discharge passage) B is as follows: the conditioned space is communicated with the intake of the blower 140 through the passage 124; the outlet of the blower 140 is communicated with the sensible heat exchanger 104 heat-exchangeable with the process air; the outlet for the regeneration air from the sensible heat exchanger 104 is communicated with the hot water heat exchanger (heater) 220 through the passage 126; the outlet for the regeneration air of the heater 220 is communicated with the inlet of the regeneration air to the desiccant wheel 103 through the passage 127; the outlet for the regeneration air of the desiccant wheel 103 is communicated with the outside space through the passage 128 so that indoor air can be introduced for use as regeneration air.

Figure 2:
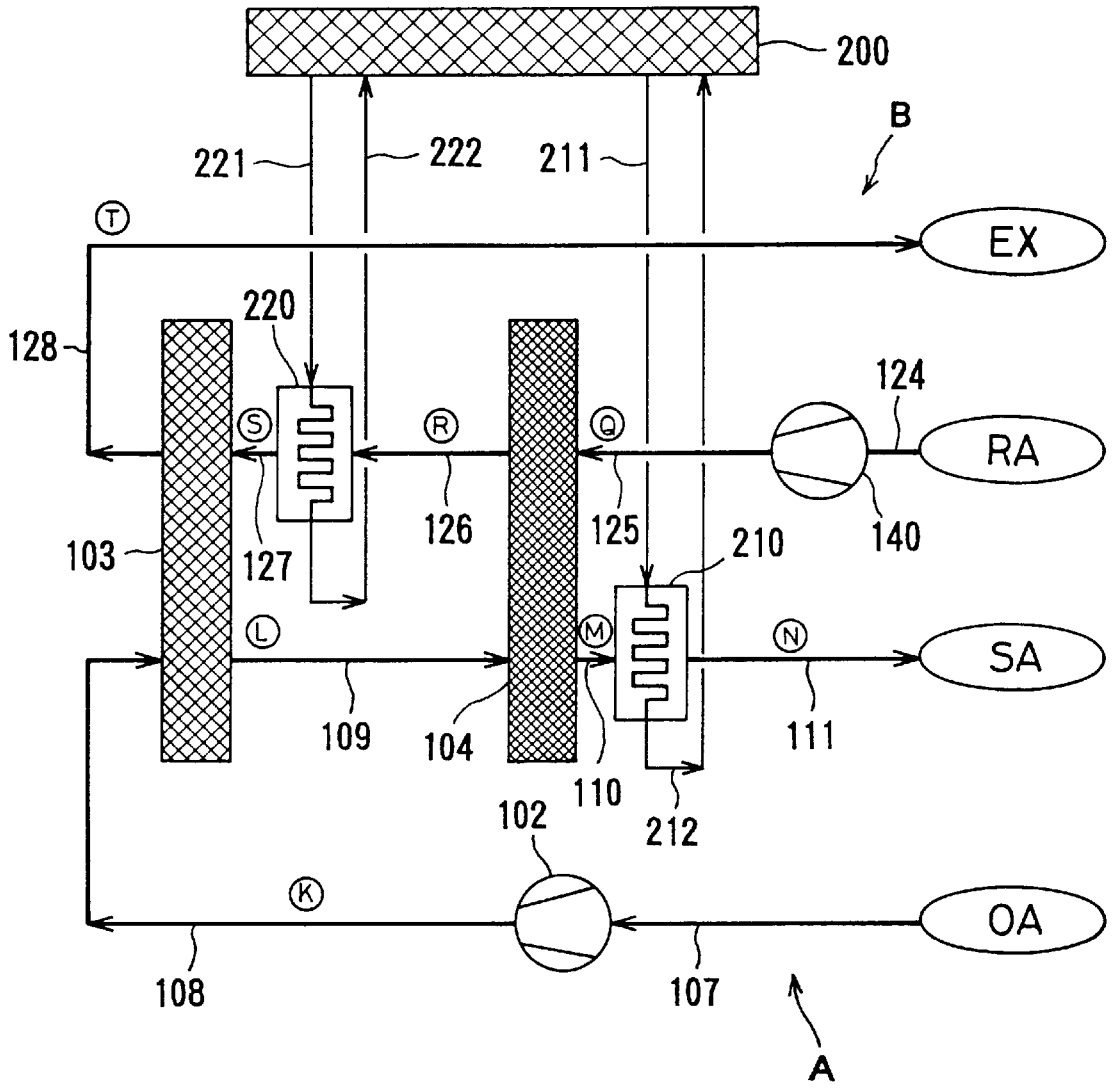
FIG. 2 is a schematic representation of the basic configuration of desiccant assisted air conditioning unit of the first embodiment.

The heating medium (hot water) inlet of the heater 220 is communicated with the outlet of the hot water circuit of the heat pump 200 through the passage 221. The hot water outlet of the hot water heat exchanger 220 is communicated with the hot water inlet of the heat pump 200 through the passage 222. The chilled water inlet of the cooler 210 is communicated with the chilled water outlet of the heat pump 200 through the passage 211, and the chilled water outlet of the cooler 210 is communicated with the chilled water inlet of the heat pump 200 through the passage 212. In FIG. 2, the circled alphabetical designations K~V refer to the thermodynamic states of the air corresponding to those in FIG. 3, and SA designates supply air (conditioned outdoor air), RA designates return air (indoor air to be discharged), OA designates outdoor air to be introduced and EX designates exhaust air to be discharged.

The operation of the air conditioning unit comprising a heat pump 200 as a heat source will be described with reference to FIG. 3 which is a psychrometric chart illustrating the working condition of the air conditioning unit 1 shown in FIG. 1. The introduced outdoor air (process air: state K) is withdrawn into the blower 102 to be pressurized through the passage 107, and the pressurized process air is forwarded to the desiccant wheel 103 through the passage 108. The humidity ratio in the process air is lowered by adsorption of moisture in the process air into the moisture adsorbent in the desiccant wheel 103, and the temperature is raised by the heat of adsorption (state L). The process air, having its humidity lowered and temperature raised, is delivered to the sensible heat exchanger 104 through the passage 109, and undergoes heat exchange with return air (regeneration air) to lower its temperature (state M). The cooled process air is forwarded to the cooler 210 through the passage 110 to be further cooled (state N). The cooled process air is supplied to the conditioning space 101 through the passage 111. By the process described above, an enthalpy difference $\Delta Q$ between the outdoor air (state K) and the supply air (state N) is generated, as well as an enthalpy difference and humidity ratio difference between the outdoor air (state K) and the indoor air (state Q) is generated to perform cooling of the conditioning space.

Regeneration process of the desiccant is as follows. Indoor air for regeneration (RA: state Q) is withdrawn into the blower 140 through the passage 124 to be pressurized, and is delivered to the sensible heat exchanger 104 to cool the process air while raising its own temperature (state R). Regeneration air further flows into the heater 220 through the passage 126, and, by being heated with the hot water, raises its own temperature to 60~80° C., and its relative humidity is decreased (state S).

This process corresponds to sensible heat change in the regeneration air, and because the specific heat of air is significantly lower than that of hot water and air shows a large temperature difference, heat exchange can be performed effectively even if the heater is operated at a lower hot water flow rate with a large temperature difference. By operating the heater with a large temperature difference, the hot water flow rate can be reduced so as to save the necessary power for circulating the hot water.

Regeneration air with lowered relative humidity from the heater 220 flows through the desiccant wheel 103 to remove its moisture (state T). Spent air from the desiccant wheel 103 flows through the passage 128 to be exhausted out as waste air.

The process described above, i.e., regeneration of desiccant on one hand and dehumidification and cooling of process air on the other, is repeated to provide air conditioned outdoor air to the conditioning space.

Figure 4:
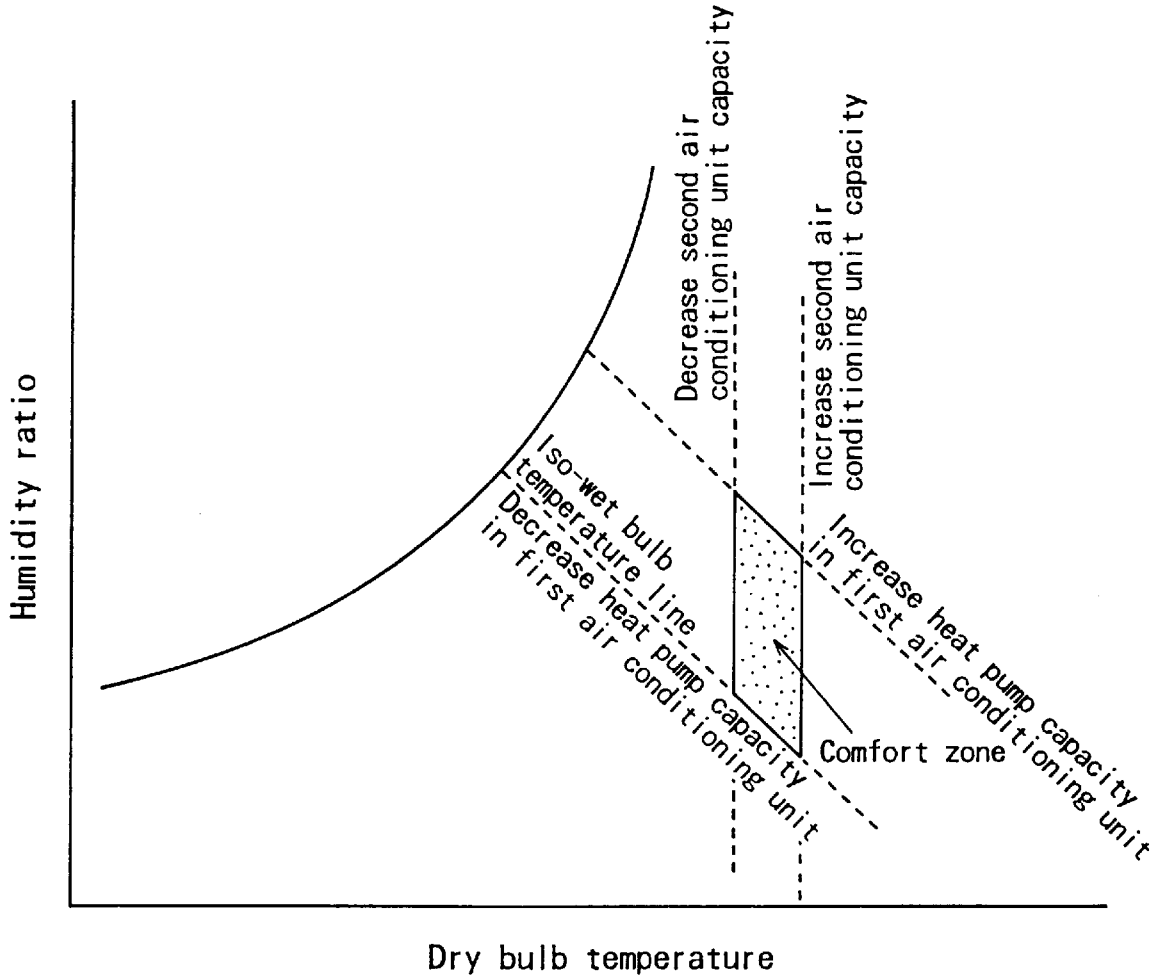
FIG. 4 is a graphical representation of the control methodology in the first embodiment.

Next, a control method for the air conditioning system based on the outdoor air intake type air conditioning unit 1 and the circulation type air conditioning unit 3 by means of the controllers 10, 20 will be explained with reference to FIG. 4. In this embodiment, the control functions are primarily assigned so that the first air conditioning unit 1 removes the humidity while the second air conditioning unit 3 adjusts the air temperature. In this example, a wet bulb thermometer is used as the humidity sensor 6. This is because the wet bulb temperature, as a function of the temperature and the relative humidity, is a fairly reliable direct indicator of the comfort or discomfort index for people, and the indicated values of the thermometer are being used directly to control the comfort level.

In more detail, upper and lower limits of the wet bulb temperature, which have been predetermined, are stored in the controller 10. When the indicated values of the humidity sensor 6 are within the limits, the operational capacity of the heat pump device 200 in the first air conditioning unit 1 is lowered, and when the values are beyond the limits, the operational capacity is raised. The controller 10 controls the capacity of the first air conditioning unit 1 in this manner.

In the meantime, using the same methodology, the upper and lower limits stored in temperature controller 9 are used to control the operational capacity of the second air conditioning unit 3 to maintain the temperature of the conditioning space 2 within a specified range. Accordingly, both the humidity and temperature within the conditioning space 2 are automatically regulated to be within the comfort zone as indicated in FIG. 4, which shows the humidity ratio on the vertical axis and dry bulb temperature on the horizontal axis.

Figure 5:
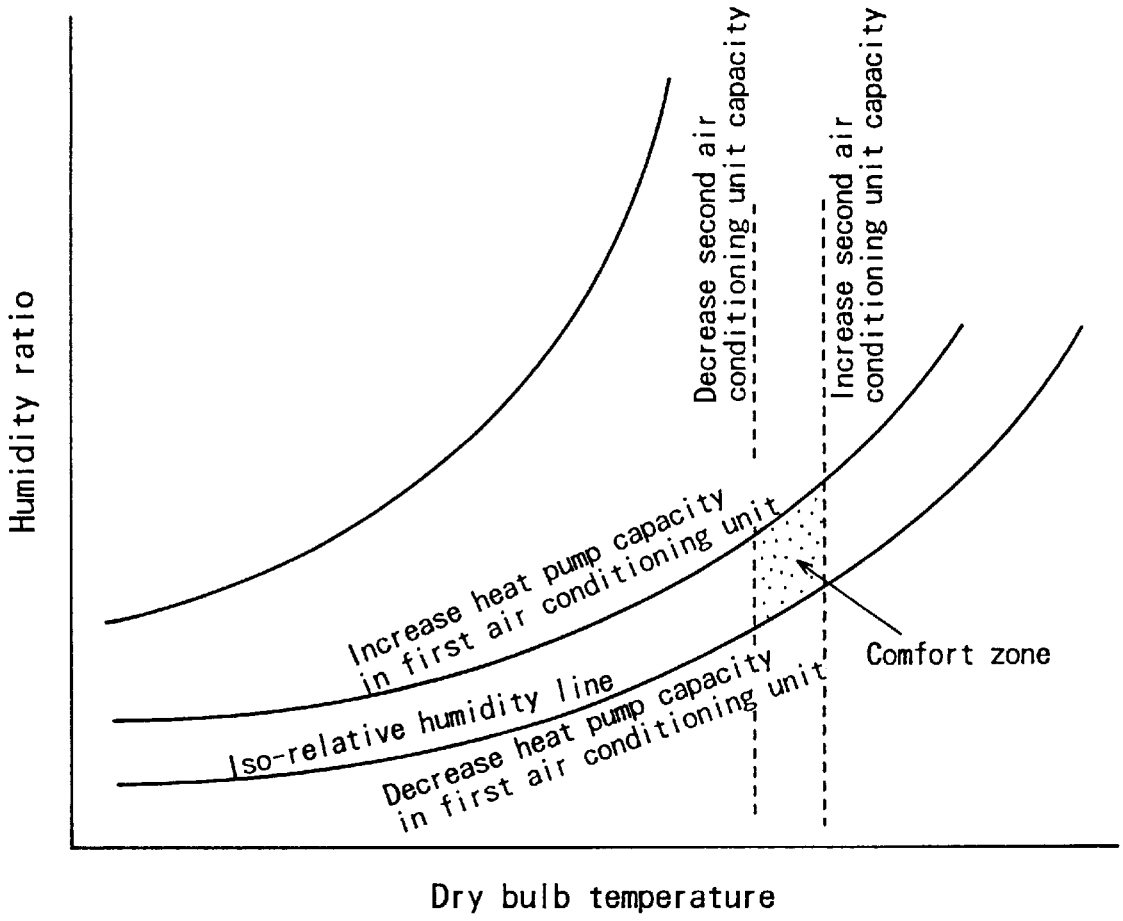
FIG. 5 is a graphical representation of another method of control in the first embodiment.
Figure 6:
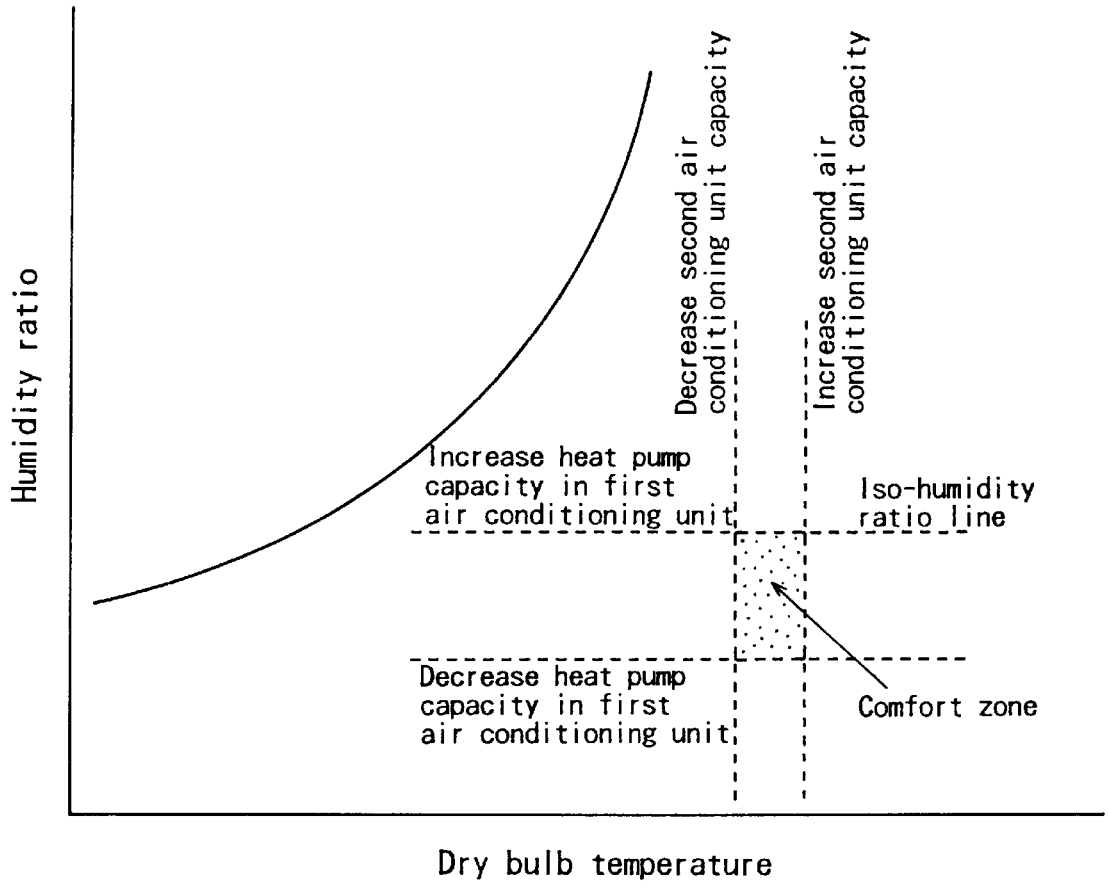
FIG. 6 is a graphical representation of still another method of control in the first embodiment.

FIG. 5 is a comfort zone graph for explaining another controlling method of the air conditioning system where a relative hygrometer is used as the humidity sensor 6. Therefore, the relative humidity is used as a controlling indicator for the first air conditioning unit 1, and the comfort zone is defined by the upper and lower limits of the relative humidity scale. Control logic for this example is the same as the one described above, and it will not be repeated. FIG. 6 is an example of comfort zone graph for explaining another controlling method of the air conditioning system where an absolute hygrometer as the humidity sensor 6.

In the above embodiments, the controllers 10, 20, humidity/temperature sensors are separately designated, but it is obvious that they may be combined in one unit. Also in the above examples, the comfort level controls were provided by controlling the operations of first air conditioning unit 1 and second air conditioning unit 3, but other parameters such as numerical flow rate control or simple ON/Off control can also be used.

Figure 7:
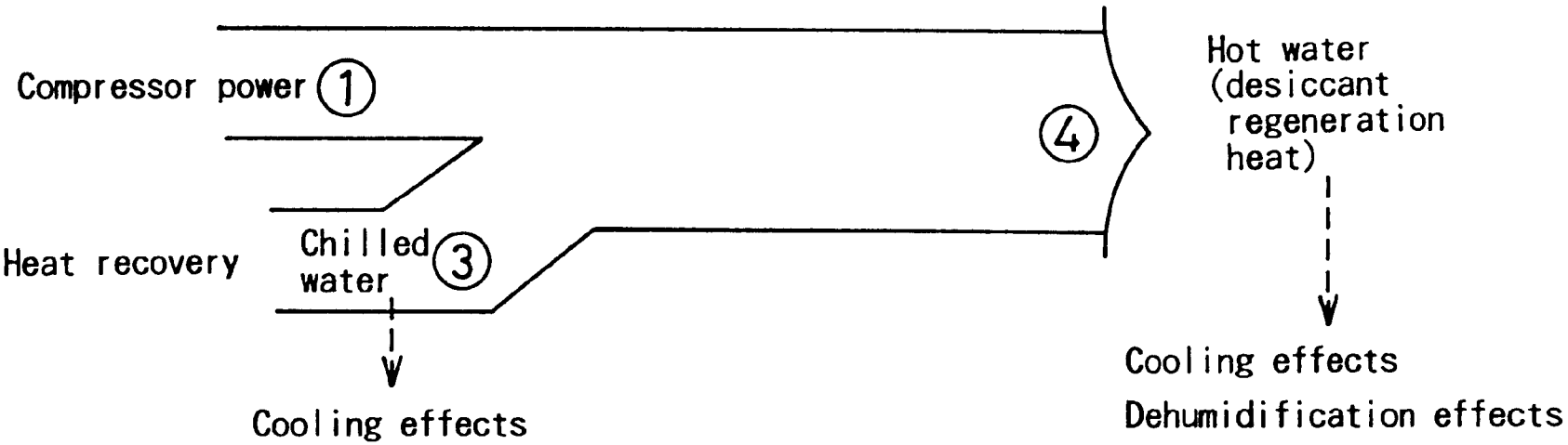
FIG. 7 is an illustration of the flow of heat in the heat pump device of the first embodiment.

FIG. 7 shows the flow of heat in the heat pump section of the desiccant assisted air conditioning system of such a configuration of FIG. 2. FIG. 7 shows that the heat input consists of the heat extracted from the chilled water and the power for the compressor driver, and the output heat is totally directed to heating the hot water. In this type of heat pump, temperature lift of the heat pump is produced by the heat extracted from chilled water of 15° C. to raise it to 70° C., making a temperature lift of at least 55° C., and compared with the value of conventional temperature lift of 45° C., it is higher by 22%. Thus the pressure ratio becomes slightly higher, and assuming a value of the power to the compressor driver as 1 thermal unit, the coefficient of performance (COP) can be designed to be about 3. on the other hand, the heat output is 1+3 making a value of 4, and all of this heat is input to heat the hot water for use in the desiccant assisted air conditioning system.

Figure 3:
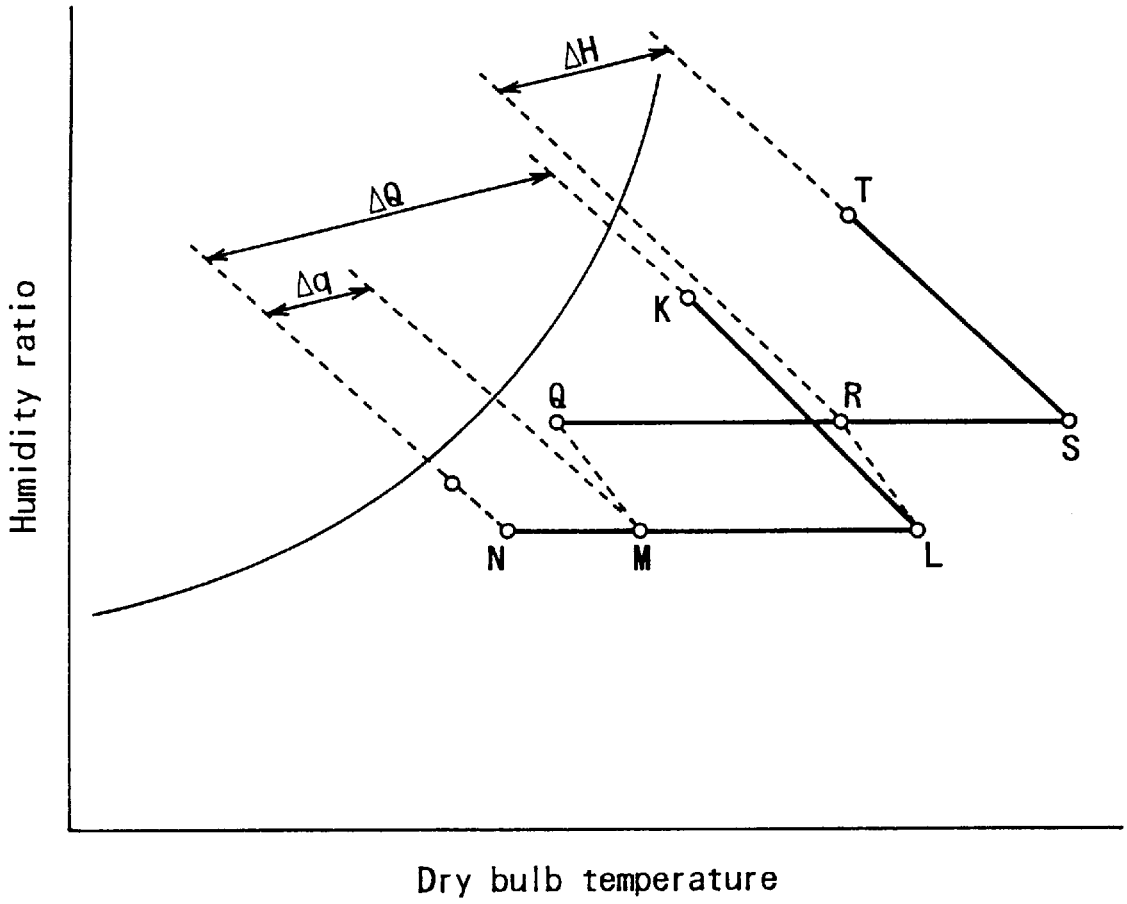
FIG. 3 is a psychrometric chart of the operational cycle of the desiccant assisted air conditioning system of the first embodiment.

The value of COP to show the energy efficiency of the conventional desiccant assisted air conditioning unit as a single machine unit is given by dividing the cooling effect ($\Delta Q-\Delta q$) shown in FIG. 3 by the regeneration heat $\Delta H$, and it is generally reported that this value is at the most about 0.8~1.2. Therefore, if the value of COP for the desiccant assisted air conditioning system is assumed to be about 1, it leads to a value of 1 thermal unit for cooling effect by the desiccant assisted air conditioning unit. Thus, if the input power for the compressor driver in the heat pump is assumed to be 1 thermal unit, then the drive heat input is 4 thermal units for the desiccant assisted air conditioning system. It means that hot water contributes additional cooling effect of 4 thermal units. In the present system, additional cooling effects add to 3 thermal units from the chilled water, thus making a total value of 7 thermal units for the cooling effect. The value of COP for the present system is given by:

$$COP=\text{Cooling effect/compressor input}=7$$

which is considerably higher than the conventional COP values of less than 4.

In addition to this energy saving, another energy saving is also provided by the second air conditioning unit 3. In other words, by using the desiccant assisted air conditioning unit 1, because it is possible to have lower humidity ratio in the supply air SA for the conditioning space than that in the return air RA, the moisture is prevented from being introduced into the conditioning space. Therefore, the second air conditioning unit 3 does not need to dehumidify the process air, and it only needs to remove the sensible heat in the indoor air. It follows that the second air conditioning unit 3 only needs to cool the indoor air to about 20° C., and the vaporization temperature can be set about 10° C. higher than normal. This leads to a lower temperature lift value (for example, from 40 to 30° C.).

Accordingly, the energy saving efficiency is given by:

$$DT_1/DT_2=30/40=0.75$$

indicating that it saves about 25%.

Therefore, the overall system efficiency can be calculated by knowing that sensible heat factor (SHF) is 0.7 in an average air conditioning load, and that the load ratio for the air conditioning unit for latent heat processing and the air conditioning unit for sensible heat processing is about 3:7, the energy saving efficiency is given by:

$$0.3\times0.55+0.7\times0.75=0.69$$

indicating that it is about 31%.

Furthermore, because the necessity for dehumidification by the second air conditioning unit 3 has been eliminated, the necessity for drain facility has also been eliminated, resulting that the facility cost is reduced and the operational protocol has been simplified.

As explained above, according to the first embodiment using a hybrid system which combines a heat pump device and a desiccant assisted device, a large energy saving has been achieved in latent heat processing. The result is that not only the operating cost for the air conditioning system is lowered but also the condensation drain facility for the air conditioning device is not necessary that the overall system has been simplified and made economical.

Further, by assigning separate functions of dehumidification and temperature control to each of the air conditioning units, i.e. dehumidification by the first air conditioning unit and temperature control by the second air conditioning unit, both energy saving and moisture removal are accomplished simultaneously. Comfort level in the conditioning space is maintained simply and automatically by operating the air conditioning system in accordance with the indication of the humidity sensor provided in the conditioning space.

Figure 8:
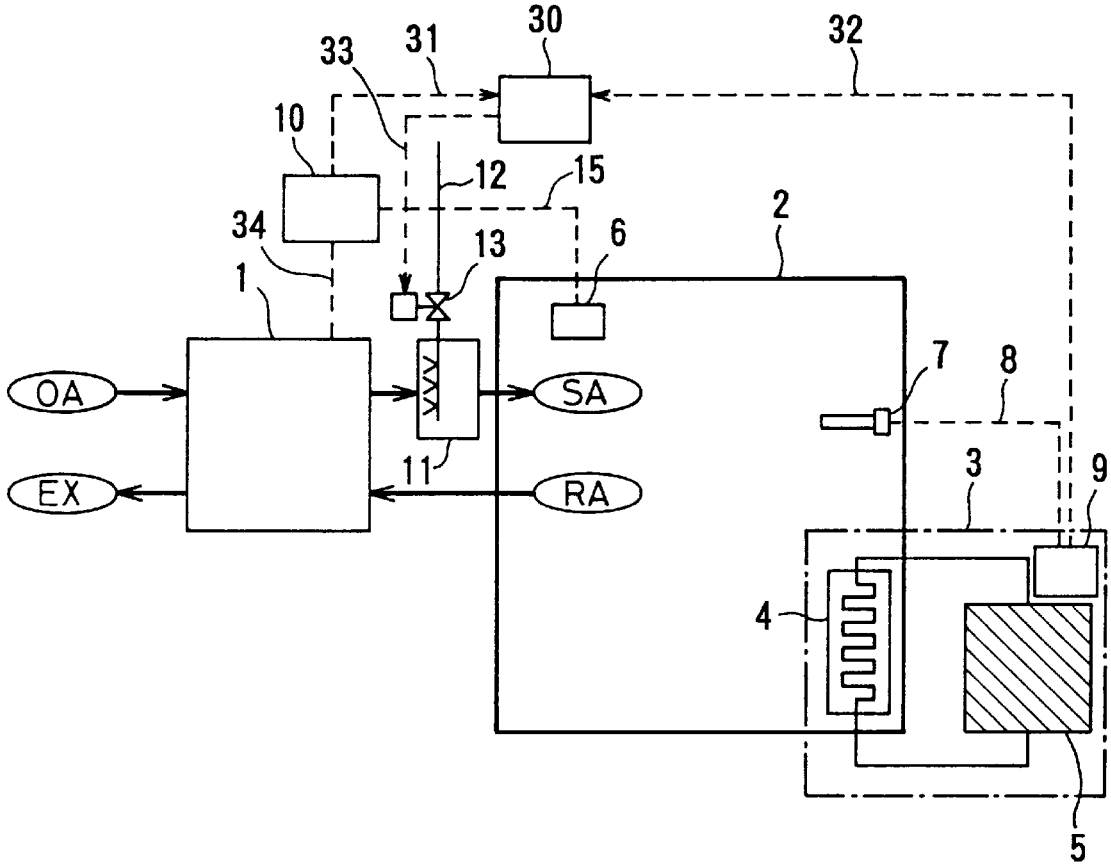
FIG. 8 is a schematic representation of a second embodiment of the air conditioning system of the present invention.

FIG. 8 is a schematic representation of the basic configuration of a second embodiment of the air conditioning system of the present invention, based on a hybrid system combining an outdoor air intake type first air conditioning unit 1 for processing and introducing outdoor air into the processing space 2; and a circulation type second air conditioning unit 3 for circulating and processing indoor air in the conditioning space 2. Additionally, a humidifier 11 having a water supply pipe 12 and a shutoff valve 13 is provided in the passage for the process air (outdoor air) between the first air conditioning unit 1 and conditioning space 2. The first air conditioning unit 1 is provided with a desiccant conditioning device and an inlet passage A for admitting outdoor air in cooling operation, and an outlet passage B for discharging the indoor air to outside environment. The passages A, B are interchanged in room heating operation so that the passage B is used as the inlet and the passage A is used as the outlet. Such arrangements are well known to those skilled in the art, and need not be described, and the following explanations are provided only for a cooling cycle of the operation.

The control device configuration shown in FIG. 8 will be explained in the following. Each of the components of the air conditioning system, i.e. first air conditioning unit 1, second air conditioning unit 3 and the humidifier 11, is provided with its own controller. Inside the room, there is provided a humidity sensor 6, dry bulb temperature sensor 7, and the output signals from the humidity sensor 6 are input to the controller 10 of the first air conditioning unit 1 through the signal path 15, and the output signals from the dry bulb sensor 7 are input to the temperature controller 9 of the second air conditioning unit 3 through the signal path 8. Output signals from the controllers 9, 10 are input through the signal paths 31, 32 to the moisture controller 30 for controlling the humidifier 11.

Figure 9:
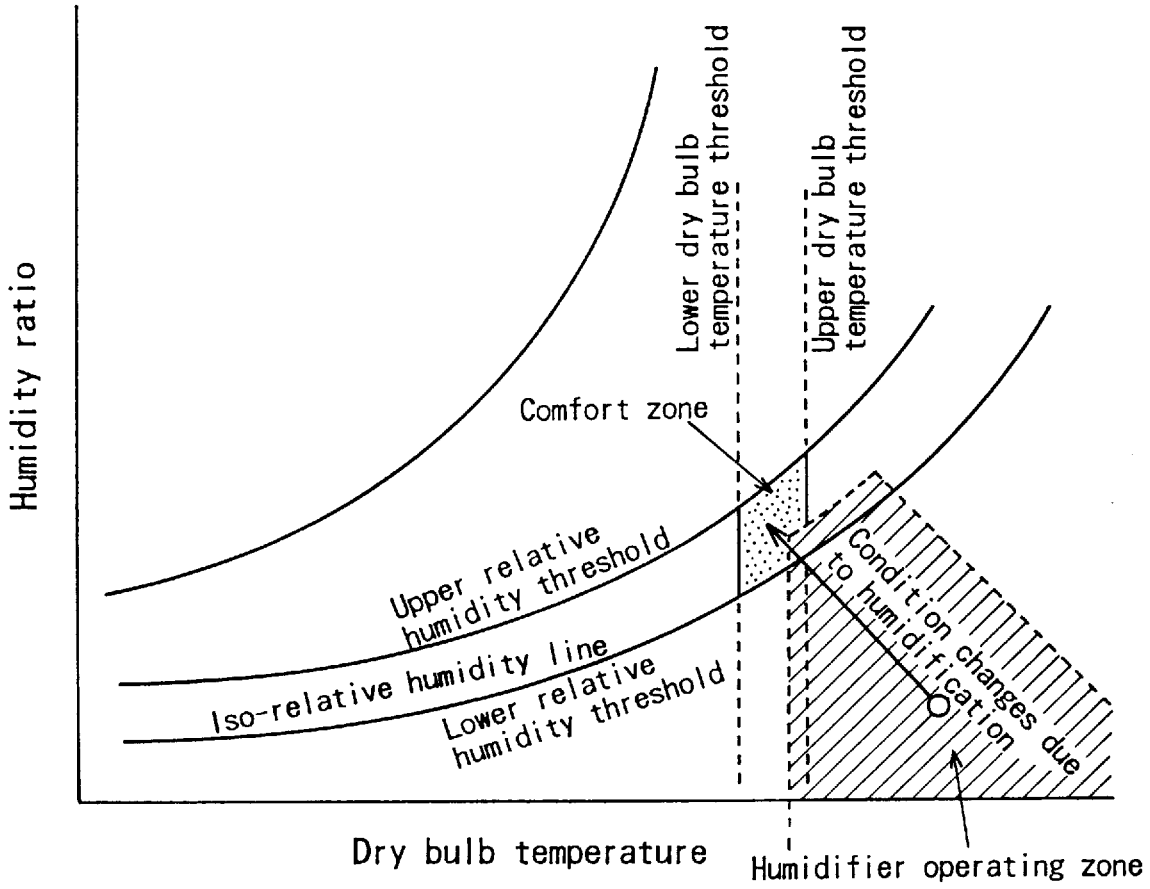
FIG. 9 is a psychrometric chart of the control method for the air conditioning system shown in FIG. 8.

The operation of the system when the humidifier 11 is not used is the same as the previous embodiment, and the explanation will not be repeated. The following description applies to the case of turning on the humidifier 11. FIG. 9 is a psychrometric chart for showing the effects of the humidifier 11 in the conditioning space 2. The conditioning space is controlled so that it is maintained in the comfort zone shown in FIG. 9 by operating the second air conditioning unit 3 so that the bulb temperature remains within a given range, and operating the heat pump device contained in the first air conditioning unit 1 so that the relative humidity remains within a given range. Comfort level can also be maintained by permitting the dry bulb temperature to rise as well as raising the capacity of the first air conditioning unit 1 simultaneously so as to raise the process air temperature (note right lower region in FIG. 9), followed by humidification of process air by a water spray type or evaporative type humidifier to bring the condition from a high temperature region to a lower temperature region into the comfort zone.

Figure 10:
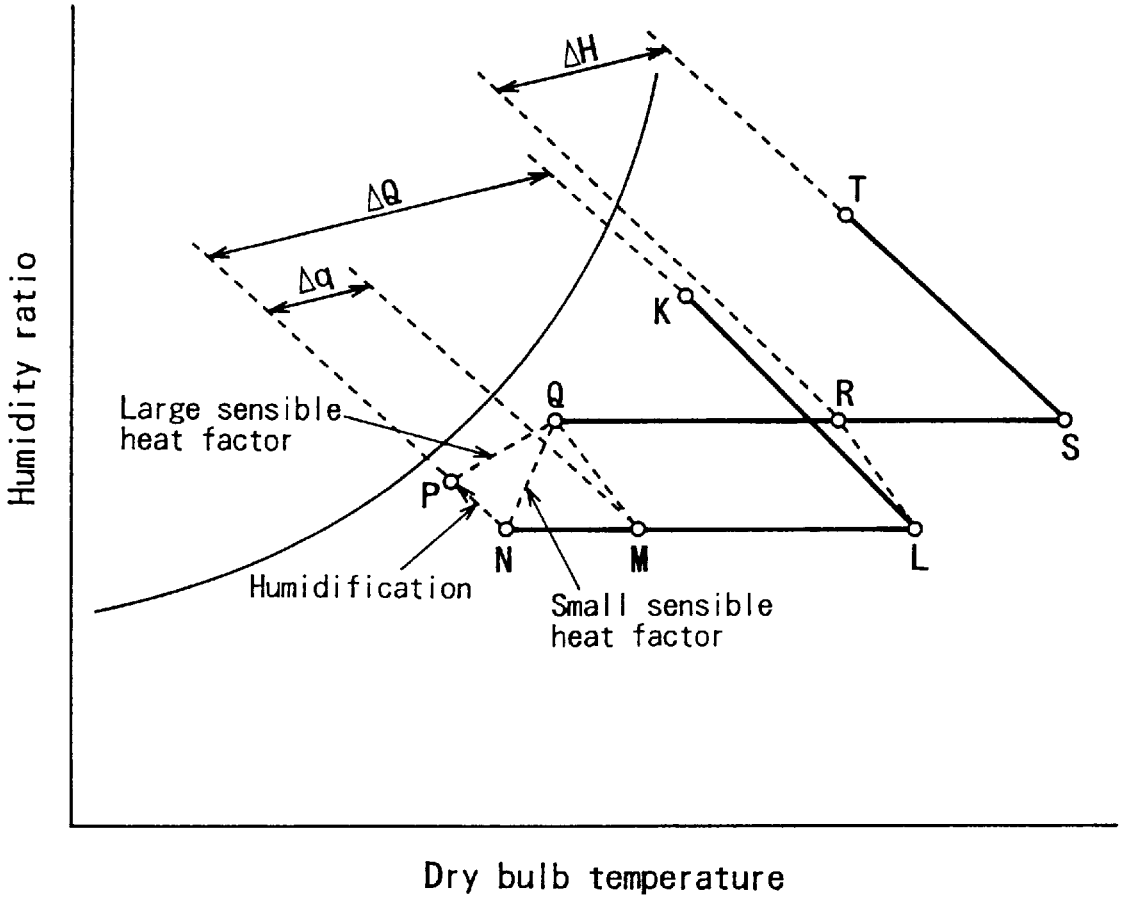
FIG. 10 is a psychrometric chart of the desiccant conditioning cycle of the air conditioning system shown in FIG. 8.

The process of condition change may also be explained with reference to FIG. 10. When the humidifier 11 is not operated and the first air conditioning unit 1 is operated, the process air exiting the first air conditioning unit 1 is in state N. The valve 13 of the humidifier 11 is opened at this time, and water is supplied to the humidifier 11 through the water supply pipe 12, and the state of the process air at the outlet of the humidifier 11 moves to state P. In FIG. 10, when there is no humidification, the sensible heat factor (SHF) between the indoor air at state Q to supply air at state N is defined by the slope Q to N while, when supply air is humidified, the state of the supply air moves to P, and the sensible heat factor (SHF) io is defined by the slope Q to P. The magnitudes of the slopes show that the SHF value of the latter is higher than that of the former. It is seen therefore that the first air conditioning unit 1 is also able to remove sensible heat, and the process heat loading for the first air conditioning unit 1 can be increased. When more of the air processing load is accepted by the first air conditioning unit 1, which inherently has a higher energy efficiency as described above, overall energy efficiency can be increased even more significantly.

However, it should be noted that such energy saving and comfort zone operation can be achieved only if humidification is carried out when the indoor air is in a right lower region of operation in FIG. 9, i.e., the dry bulb temperature is higher than the predetermined threshold, and the humidity is lower than the predetermined threshold. When the humidifier 11 is operated when these conditions are not met, for example if the dry bulb temperature is lower than the threshold, then the temperature of indoor air will drop, leading to chill and discomfort, thus departing from the comfort zone operation. In the second embodiment, the following procedure is taken to operate the humidifier 11 and maintain comfort zone operation while achieving energy saving.

That is, the output signal from the dry bulb temperature sensor 7 in the conditioning space 2 is input into the controller 9 of the second air conditioning unit 3, and if the temperature detected by the sensor 7 exceeds the predetermined temperature stored in the controller 9, corresponding electrical signals as contact signals are transmitted to the humidifier controller 30 through the signal path 32. Further, the output signal from the humidity sensor 6 is input into the controller 10 of the first air conditioning unit 1 through the signal path 15. When the detected humidity by the sensor 6 is lower than the predetermined humidity threshold of the first air conditioning unit 1, corresponding electrical signals as contact signals are transmitted to the controller 30 of the humidifier 11 through the signal path 31.

When both conditions, i.e. the output temperature from the temperature sensor 7 is higher than the set temperature value in the second air conditioning unit 3 and the output humidity from the humidity sensor 6 is lower than the set humidity value in the first air conditioning unit 1, are simultaneously satisfied, they indicate that the condition of the indoor air in the conditioning space 2 is in the lower right region shaded with oblique lines in FIG. 9. These are the conditions to allow activation of the humidifier 11, the controller 30 opens the valve 13 and supplies water from the water supply pipe 12 to operate the humidifier 11 by sending a signal through the signal path 33. Activation of the humidifier 11 lowers the dry bulb temperature while the humidity is increased so that the condition in the conditioning space approaches the comfort zone.

It is not required that the settings for the dry bulb temperature and the humidity value be necessarily the target values for comfort maintenance in the conditioning space 2, and they may be just provisional values associated with proper functioning of the humidifier 11. Also, when the ambient temperature is extremely high such as might be encountered during the start-up period of the air conditioning system, any addition of moisture to the indoor air will only increase the latent load on the air conditioning unit 1, therefore, it is preferable to restrict the operation of the humidifier 11. Such restrictions may be placed by operating a timer with the humidifier 11 or setting an upper limit on the dry bulb temperature so that the operation of the humidifier 11 may be suspended temporarily. Also, to provide comfort zone operation during a heating operation of the air conditioning unit, if higher humidity is required in the process air to be admitted into the room, then the humidifier 11 may also be operated.

Figure 11:
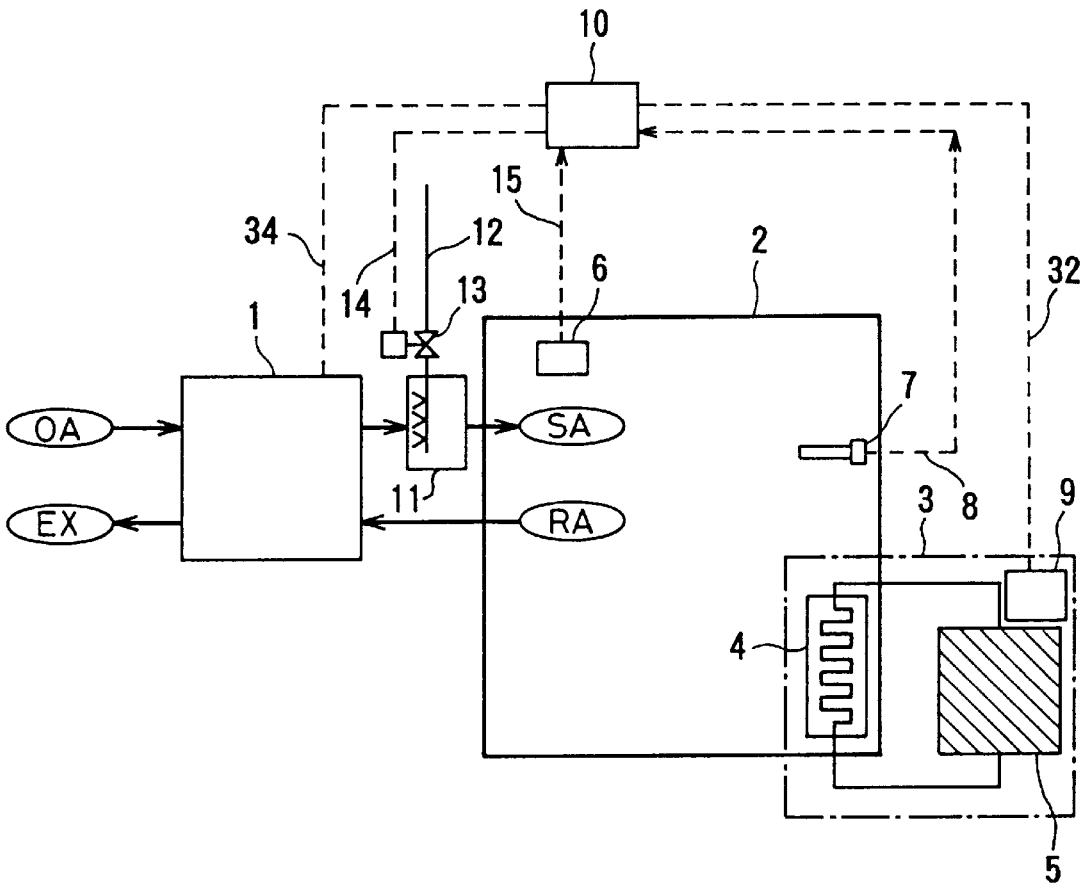
FIG. 11 is a schematic representation of a third embodiment of the air conditioning system of the present invention.

FIG. 11 shows a third embodiment. In the previous embodiments, the basic component devices of the air conditioning system (units 1, 3 and humidifier 11) are independent units and each is given its own controller. In this embodiment, one controller is used to control the three basic components so that the output signals from the humidity sensor 6 and the temperature sensor 7 are input into this master controller. The construction and operation of the component devices are the same as before, and their explanations will not be repeated.

The control steps for the air conditioning system of the present embodiment will be explained with reference to FIGS. 12 to 15. The operating parameters for the comfort zone are pre-entered into the controller 10 by defining the upper and lower limits for the dry bulb temperature and those for the relative humidity as shown in FIG. 15 (st 1, st 11).

Figure 12:
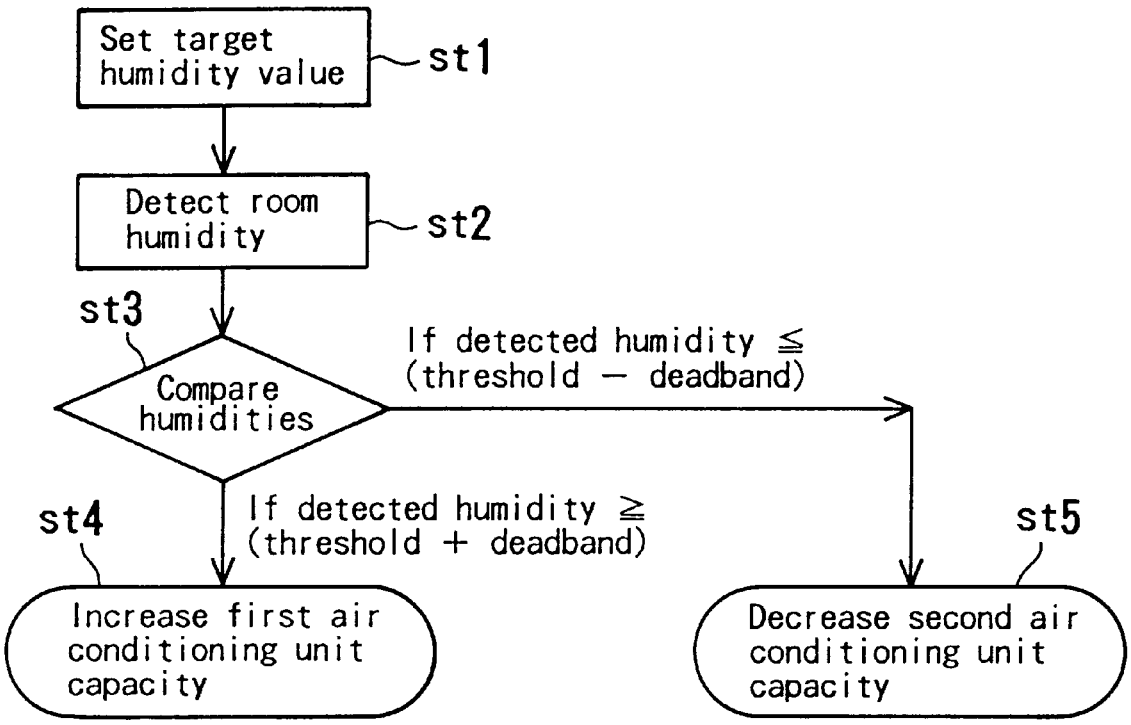
FIG. 12 is a flowchart for a control method for the air conditioning system shown in FIG. 11.

As shown in FIG. 12, the controller 10 receives a signal representing a measurement from the humidity sensor 6 in the conditioning space 2 through a signal path 15 (st 2), then the controller 10 compares the detected value with the target humidity value stored therein (st 3). If the detected value is higher than a sum of the target value plus deadband, the controller 10 sends a command signal through a signal path 34 to increase the capacity of the heat pump device in the first air conditioning unit 1, and increases the regeneration heating capacity of the desiccant in the first air conditioning unit 1 to increase the dehumidification ability (st 4) so as to lower the humidity in the conditioning space 2. When the detected value is lower than a difference value obtained by subtracting the deadband from the target value, then the controller 10 sends a command signal to lower the capacity of the heat pump device in the first air conditioning unit 1 through a signal path 34 so that the regeneration heating capacity of the desiccant in the first air conditioning unit 1 is lowered (st 5).

Figure 13:
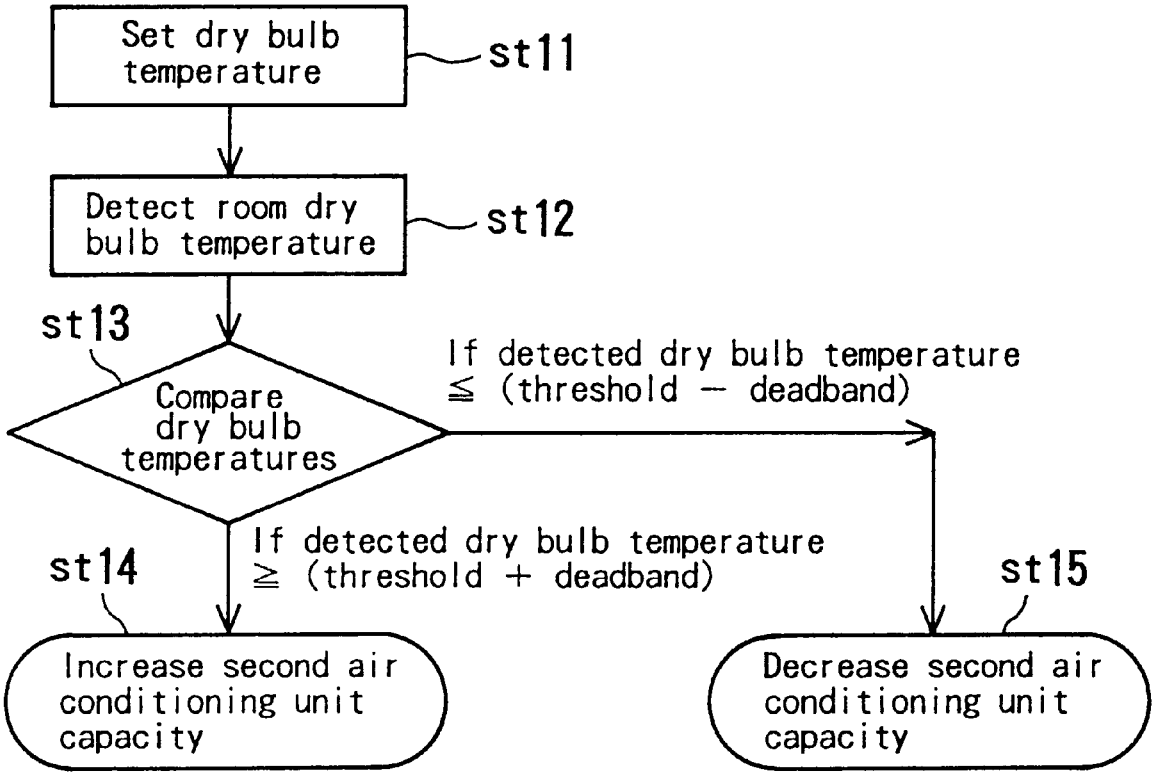
FIG. 13 is a flowchart for another control method for the air conditioning system shown in FIG. 11.

As shown in FIG. 13, the controller 10 further receives another signal representing the detected value of dry bulb temperature from the dry bulb temperature sensor 7 through a signal path 8 (st 12), and compares the detected value with the target value of dry bulb temperature stored therein (st 13). If the detected value is higher than a sum of the target value plus deadband, the controller 10 sends a command signal to increase the capacity of the second air conditioning unit 3 through a signal path 23 so as to increase the sensible heat cooling capacity of the second air conditioning unit 3, and supplies cooled air to the conditioning space 2 (st 14). On the other hand, if the detected value is lower than a difference value obtained by subtracting the deadband from the target value, then the controller 10 sends a command signal to lower the capacity of second air conditioning unit 3 through the signal path 32 so that the sensible heat cooling capacity is lowered (st 15).

The process steps presented to this point relate to the case of maintaining the comfort zone in the conditioning space 2 without using the humidifier 11. In the present embodiment, additional control techniques are made available when there are spare capacities in the heat pump 200 of the first air conditioning unit 1. Such spare capacities are manifested by, for example, that the revolutional speed of the compressor has not yet reached its specified upper limit, that a signal is generated to lower its capacity, that a signal is generated to lower the revolutional speed of the compressor, or that a signal to stop the compressor is generated. In such cases, the controller 10 issues a command signal to counter such indications for increasing its capacity through a signal path 34, and at the same time, generates a command signal to lower the capacity of the second air conditioning unit 3 through the signal path 32 by an amount corresponding to the increased capacity for the first air conditioning unit 1.

Figure 14:
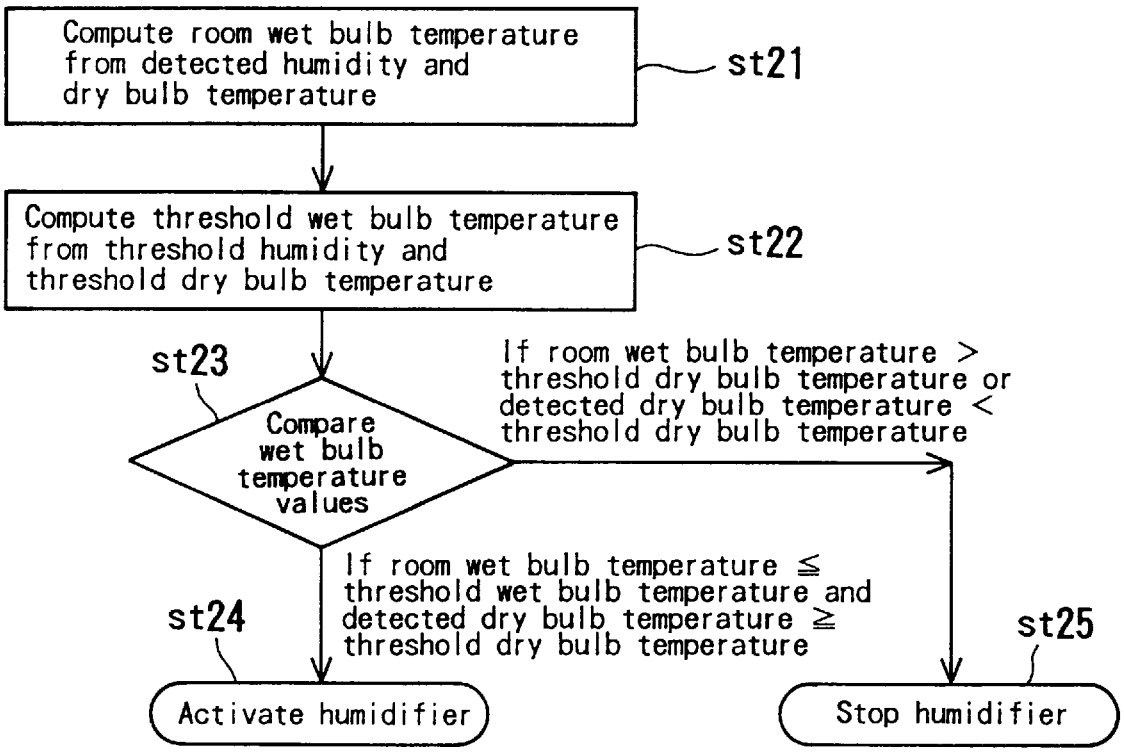
FIG. 14 is a flowchart for still another control method for the air conditioning system shown in FIG. 11.
Figure 15:
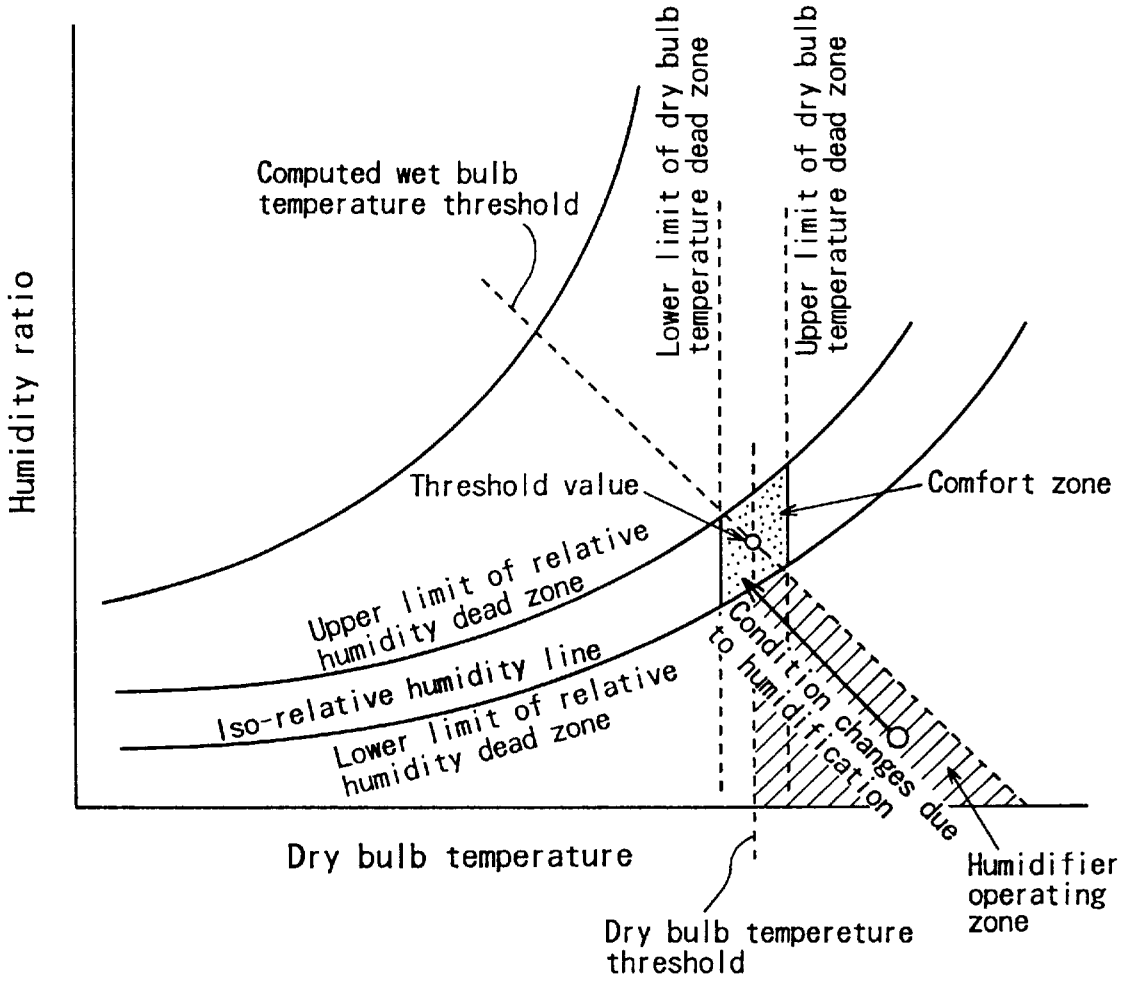
FIG. 15 is a psychrometric chart showing the control methodology for the air conditioning system shown in FIG. 8.

In this case, as shown in FIG. 14, the controller 10 computes a target wet bulb temperature on the basis of the humidity predetermined threshold and the dry bulb temperature predetermined threshold (st 21), computes the room wet bulb temperature on the basis of the detected humidity and the detected dry bulb temperature (st 22), and compares those computed wet bulb temperatures (st 23). If the room wet bulb temperature is lower than the target and the present dry bulb temperature is higher than the predetermined threshold, it indicates that the environment in the conditioning space 2 in a shaded lower right region in FIG. 15. The conditions for operating the humidifier 11 are therefore fulfilled, and the controller 10 issues a command signal through a signal path 14 to open the valve 7 to activate the humidifier 11 (st 24). The operation of the humidifier 11 lowers the dry bulb temperature and increases the dry bulb temperature so as to move the environment in the conditioning space 2 towards the comfort zone. When the detected wet bulb temperature is higher than the target or the detected dry bulb temperature is less than the predetermined threshold, the controller 10 issues a command signal to close the value 7 to stop the operation of the humidifier 11 through the signal path 14 (st 25).

Figure 16:
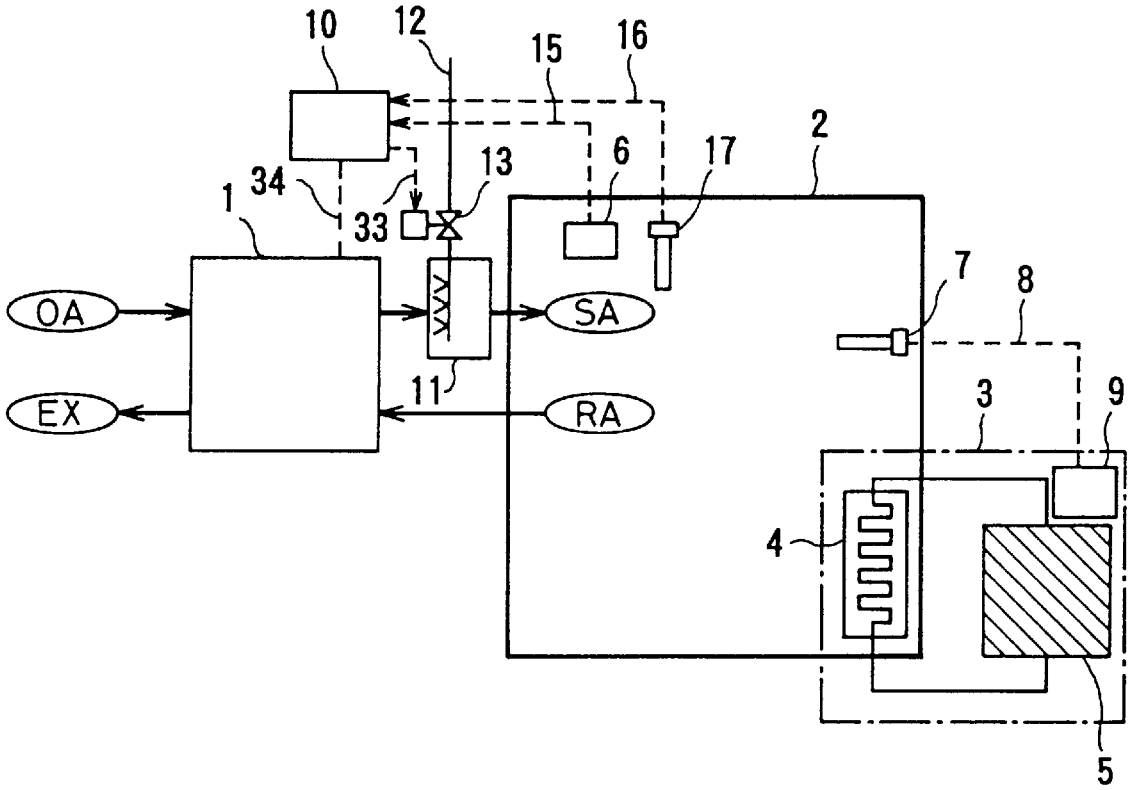
FIG. 16 is a schematic representation of a fourth embodiment of the air conditioning system of the present invention.
Figure 17:
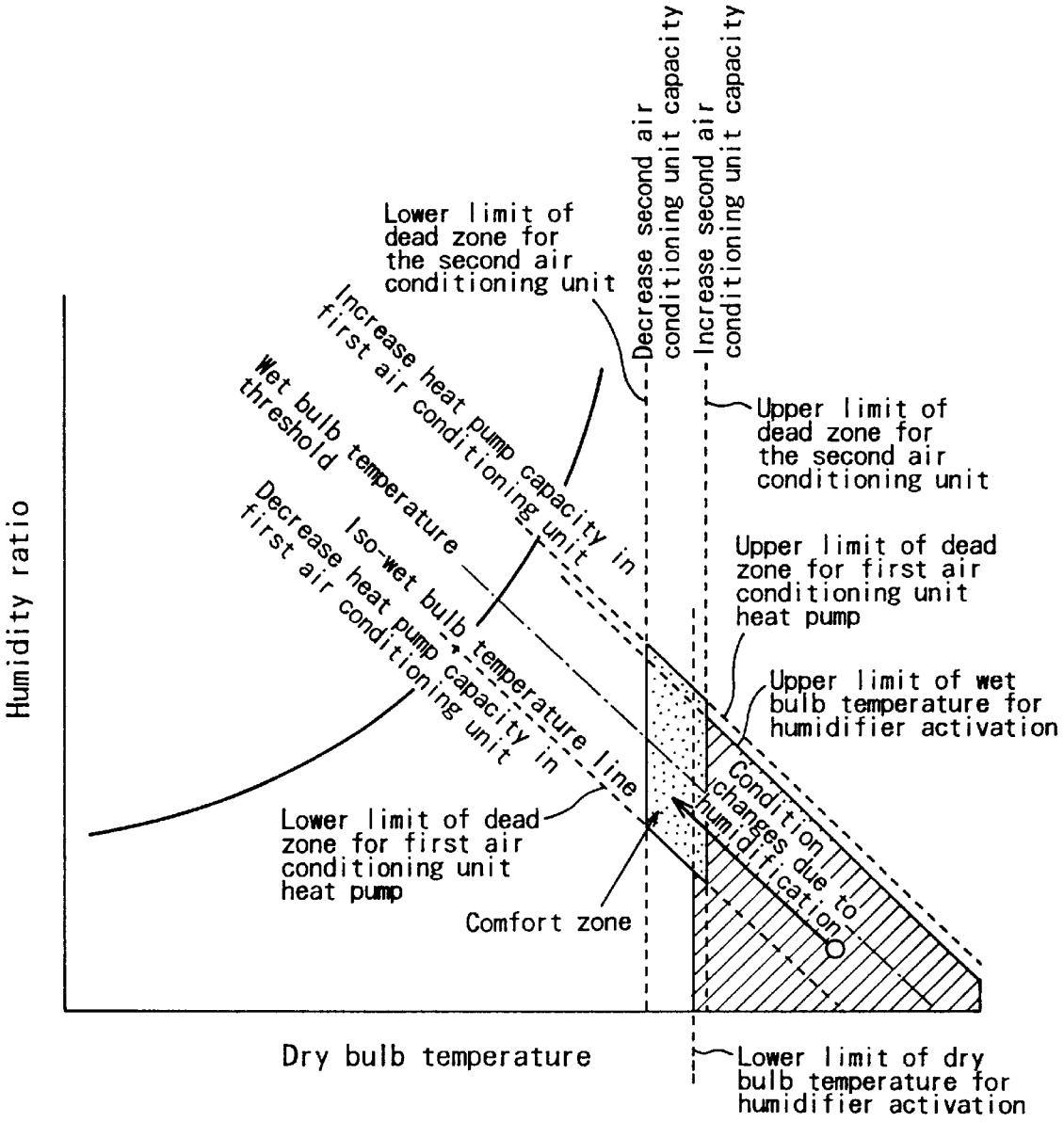
FIG. 17 is a psychrometric chart of the control method for the air conditioning system shown in FIG. 16.
Figure 18:
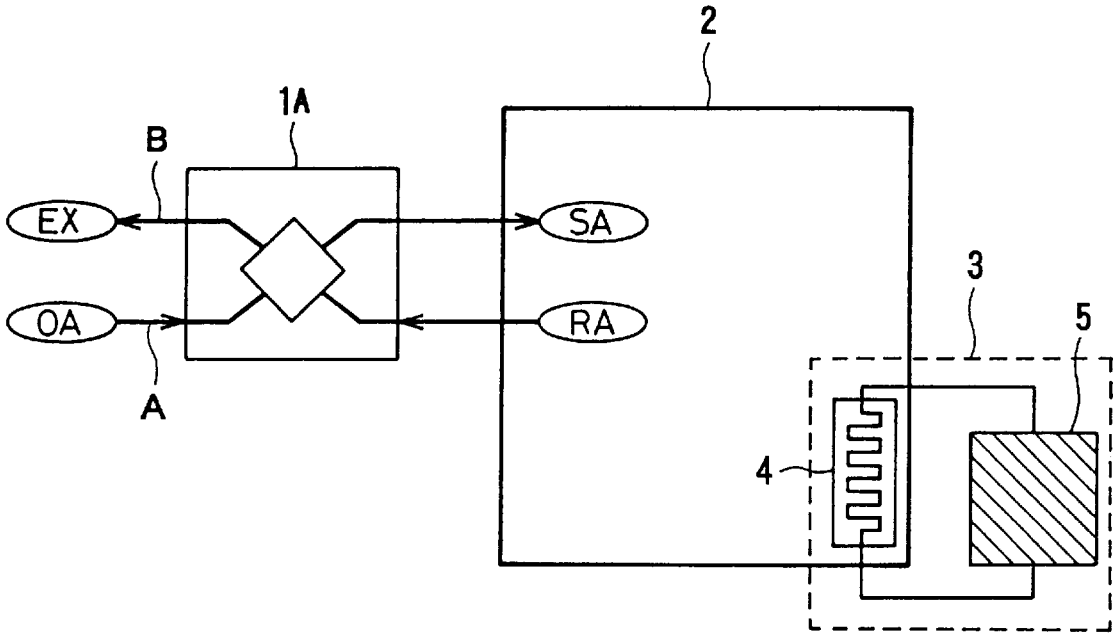
FIG. 18 Prior art
FIG. 18 is a schematic representation of a conventional air conditioning system.

FIGS. 16 and 17 present the operational behavior of another embodiment. In this case, one controller 10 is used for the first air conditioning unit 1 and the humidifier 11 on the basis of the detected values of a wet bulb temperature sensor 6 and a dry bulb temperature sensor 17 provided in the conditioning space 2. The second air conditioning unit 3 is provided with its own controller 9 to which is input the signal from a temperature sensor 7 provided in the conditioning space 2.

Control process steps for this air conditioning system will be provided below. The detected signal from the dry bulb temperature sensor 17 from the conditioning space 2 is forwarded to the controller 10 of the first air conditioning unit 1 through a signal path 16, and the detected signal from the wet bulb temperature sensor 6 in the conditioning space 2 is forwarded to the controller 10 of the first air conditioning unit 1 through a signal path 15. If the detected temperature of the dry bulb temperature sensor 17 is higher than the predetermined threshold and if the detected temperature of the wet bulb temperature sensor 6 is lower than the predetermined threshold, then it can be concluded that the environment in the conditioning space is in the shaded lower right region in FIG. 17, and the conditions for operating the humidifier 11 are fulfilled. The controller 10 issues a command signal to open the valve 13, and supplies water from the water supply pipe 12 to operate the humidifier 11.

The operation of the humidifier 11 lowers the dry bulb temperature and simultaneously the humidity is increased to move the environment in the conditioning space 2 towards the comfort zone. The process of humidification by a water sprayer or vaporizer results in an isenthalpic change, and the wet bulb temperature shows little change while the dry bulb temperature drops. Therefore, when the humidifier 11 is operated on the basis of the necessary conditions specified, i.e., the wet bulb temperature reading is lower than the predetermined threshold and the dry bulb temperature reading is higher than the predetermined threshold, the feeling of discomfort produced by excessive addition of humidity to the conditioning space will be avoided.

Further, because the sensors 6, 17 and the control circuit 33 for the water supply valve 13 for the humidifier 11 are connected to the controller 10 of the first air conditioning unit 1, the humidifier 11 is controlled by controller 10 alone to provide a comfort environment in the conditioning space 2, leading to a simplified conditioning operation as well as to a possibility of integrating the humidifier 11 with the first air conditioning unit 1 to provide a compact air conditioning unit.

The predetermined thresholds for the dry bulb temperature and the wet bulb temperature need not be the target values for the conditioning space 2, and they may be chosen from specific operating parameters for the humidifier 11. Also, in the present embodiment, wet bulb temperature sensor 6 is used. However, because the wet bulb temperature and the enthalpy line exhibit the same type of response in the psychrometric chart, suitable enthalpy sensors may be substituted.

In any of the above embodiments, humidifier operation can be also applied during heating operation of the air conditioning system of the present invention. When it is necessary for the process air to have some additional humidity, the humidifier may be operated to produce comfort environment in the room. It should be noted that although a vapor compression type heat pump was used in the present embodiment, other heat sources may also be used so long as the device provides a heat pump effect. For example, an absorption type heat pump proposed in U.S. patent application Ser. No. 08/781,038 may also be utilized to produced the same result. Also, in the present embodiment, chilled/hot water was used as the thermal transport media, but the same effect can be obtained by using direct vaporization or condensation of refrigerant equally effectively.

As explained above, according to the present invention, an air conditioning system, based on a hybrid system combining a heat pump device, a desiccant assisted air conditioning unit which is an outdoor air intake type, and a humidifier, enables an increase in the load proportioning for the air conditioning unit which offers a high level of energy saving while maintaining the same level of comfort. The result is that the operating cost for the system is decreased.

The use of sensors to measure the environmental conditions in the conditioning space permits a controller to control the operation of the air conditioning unit, air conditioning unit and/or a humidifier so that the overall system for attaining comfort operation has been simplified. It is also possible to attain a simple design of the air conditioning system leading to a compact system integrating the functions of three separate units, i.e., the first air control device, the second control device and the humidity control device.

What is claimed is:

1. An air conditioning system comprising a first air conditioning unit for processing outdoor air and introducing processed outdoor air into indoors while discharging indoor air to outdoor; and a second air conditioning unit for processing indoor air while circulating said indoor air, said first air conditioning unit and said second air conditioning unit being provided with respective air passages independent from each other, wherein said first air conditioning unit comprises:

a desiccant device for absorbing moisture from said outdoor air and being regenerated by said indoor air; and a heat pump device functioning as a heat source for regenerating said desiccant device;

wherein a high temperature heat source of said heat pump device is used for heating regeneration air and a low temperature heat source of said heat pump device is used for cooling said outdoor air.

2. A system according to claim 1, wherein said heat exchanger transfers heat between post-desiccant outdoor air and pre-desiccant indoor air.

3. A system according to claim 1, wherein said system is further provided with a humidity sensor for detecting a humidity in a conditioning space and a control device for controlling an operation of said heat pump device in accordance with output data from said humidity sensor.

4. A system according to claim 3, wherein said system is further provided with a temperature sensor for detecting a temperature in a conditioning space and a control device for controlling an operation of said second air conditioning unit in accordance with output data from said temperature sensor.

5. A system according to claim 1, wherein said system is provided with a humidifier in a supply air passage from said first air conditioning unit to said conditioning space.

6. A system according to claim 5, wherein said system is provided with a control device for controlling the operation of at least one of said first air conditioning unit and said second air conditioning unit in accordance with output data from a humidity sensor and a temperature sensor provided in said conditioning space.

7. A system according to claim 6, wherein said control device is preloaded with a parametric representation of operating parameters including a temperature value and a humidity value so that said humidifier is activated when a detected temperature exceeds a preset upper threshold temperature and when a detected humidity is less than a preset lower threshold humidity.

8. A system according to claim 7, wherein said parametric representation is based on an indication of a wet bulb temperature sensor.

9. A system according to claim 6, wherein said temperature sensor is a dry bulb temperature sensor.

10. A system according to claim 6, wherein said humidity sensor is an absolute hygrometer.

11. A system according to claim 5, wherein said humidifier humidifies in substantially an isenthalpic process.

12. A system according to claim 5, wherein said humidifier is a water spraying type humidifier.

13. A system according to claim 5, wherein said humidifier is an evaporative type humidifier.

14. A system according to claim 1, wherein said heat pump device is an absorption type heat pump.

15. A system according to claim 1, wherein said air conditioning system is provided with a controller for controlling said system so that, when an excess capacity is available in said first air conditioning unit, said heat pump device in said first air conditioning unit is operated in an increasing mode and said second air conditioning unit is operated in a decreasing mode.

16. A system according to claim 1, wherein said heat pump device is a vapor compression type heat pump.

* * * * *